United States Patent [19]

Davis et al.

[11] Patent Number: 4,979,521

[45] Date of Patent: Dec. 25, 1990

[54] PROCESS FOR MANUFACTURING CIGARETTE RODS

[75] Inventors: James W. Davis, Lewisville; Philip A. Deal, Winston-Salem; Travis E. Howard, Clemmons; Clifford R. Marritt, Winston-Salem, all of N.C.

[73] Assignee: R. J. Reynolds Tobacco Company, Winston-Salem, N.C.

[21] Appl. No.: 451,669

[22] Filed: Dec. 14, 1989

Related U.S. Application Data

[63] Continuation of Ser. No. 221,056, Jul. 19, 1988, Pat. No. 4,899,765.

[51] Int. Cl.[5] ..... A24C 5/04

[52] U.S. Cl. ..... 131/84.1; 131/84.2; 131/286

[58] Field of Search ..... 131/288, 289, 84.1, 131/285, 291, 296, 364

[56] References Cited

U.S. PATENT DOCUMENTS

| | | | |
|---|---|---|---|
| 3,033,211 | 5/1962 | Godfrey | 131/288 X |
| 3,371,000 | 2/1968 | Davenport et al. | 131/84.1 |
| 4,186,754 | 2/1980 | Labbe | 131/288 |
| 4,409,995 | 10/1983 | Nichols . | |
| 4,474,190 | 10/1984 | Brand . | |
| 4,619,276 | 10/1986 | Albertson et al. . | |

OTHER PUBLICATIONS

*Tobacco Encyclopedia,* Edited by Ernest Voges, TJI (1984), pp. 457–459.

*Primary Examiner*—V. Millin

[57] ABSTRACT

Cigarette rods are manufactured at high rates of speed using a cigarette making machine having a tongue which is equipped such that water is continuously fed therethrough in order to exit the surface of the tongue which contacts a tobacco filler stream passing through the garniture region of the cigarette making machine. The process of introducing water through the tongue during a cigarette making operation allows the manufacture to produce a continuous cigarette rod of controlled integrity. For example, cigarettes of controlled density and firmness, and having very low amounts of hard spots, soft spots and loose ends, can be manufactured. The process provides for the manufacture of cigarettes at high speeds, and for the manufacture of cigarettes having high filling capacity tobacco blends. For example, cigarettes having blends comprising relatively high levels of volume expanded tobacco can be manufactured efficiently and effectively.

12 Claims, 3 Drawing Sheets

PROCESS FOR MANUFACTURING CIGARETTE RODS

CROSS REFERENCE TO RELATED APPLICATION

This is a continuation of application Ser. No. 07/221,056 filed on July 19, 1988, now U.S. Pat. No. 4,899,765.

BACKGROUND OF THE INVENTION

The present invention relates to the manufacture of cigarette rods; and in particular to the manufacture of cigarette rods of controlled density and firmness, and having very low amounts of hard spots, soft spots and loose ends.

Cigarettes are popular smoking articles which have a substantially cylindrical rod shaped structure and include a charge of smokable material (e.g., tobacco in cut filler form) surrounded by a paper wrapper thereby forming a tobacco rod or cigarette rod. Some cigarettes have cylindrical filters aligned in an end-to-end relationship with the tobacco rod. Typically, filters are manufactured from fibrous materials such as cellulose acetate and are attached to the tobacco rod using a circumscribing tipping material.

Popular cigarettes include blends of tobacco materials as well as blends of tobacco materials with certain amounts of tobacco substitute materials. For example, cigarettes often include blends of flue-cured, Burley and Oriental tobaccos; cut rolled tobacco stems, reconstituted tobacco materials; and volume expanded tobacco materials. Recently, however, cigarette manufacturers have been expending efforts towards providing certain cigarette products having smokable blends having high filling capacities. Typically, blends which have high filling capacities comprise relatively high levels of volume expanded smokable filler materials.

During the cigarette manufacturing process, several inspections for quality are performed. Such inspections include checks for loose ends, hard spots and soft spots. If a particular cigarette rod is not within a tolerance range set by the manufacturer, the rod is rejected. Recently, cigarette manufacturers have desired to produce cigarettes at very high rates, to produce cigarettes using high filling capacity blends, and to produce cigarettes using high amounts of volume expanded tobaccos. These factors have made it increasingly difficult to produce consistent quality cigarette rods having controlled integrity. As a result, either relatively high amounts of cigarette rods are rejected for not being within the tolerance range set by the manufacturer, or cigarettes of inconsistent integrity (and hence low quality) are produced. As a consequence, a cigarette manufacturer desiring both high quality control and a low amount of rejected cigarettes often is forced to manufacture cigarettes having relatively high levels of volume expanded smokable filler at low speeds (e.g., so as to manufacture less than about 4,000 cigarettes per minute in certain circumstances).

During the manufacture of cigarette rods, a stream of smokable filler is compressed using at least one constriction member. One of the constriction members commonly is known in the art as a tongue, a compression foot or a compacting finger. Another constriction member commonly is referred to as a scrape, shoe or short tongue. As such, the filler stream is compressed toward the center of a web of wrapping material to assist in forming the stream into a cylinder about which the web is wrapped. The majority of the compression of the filler is provided by the tongue. Should the cigarette making machine be running at a high rate of speed or the stream of filler contain a relatively high amount of volume expanded tobacco, there is a tendency for the filler to accumulate and release in an uncontrolled manner in the tongue region of the cigarette making machine because of the frictional forces which occur in the tongue region. Such an undesirable tendency of the filler to accumulate and release is increased as the speed at which the continuous cigarette rod is manufactured increases. As a consequence, a continuous rod having inconsistent amounts of filler along the length thereof will result. Such a rod of inconsistent quality will result in a large number of rejected cigarettes or cigarettes of poor consistent quality.

It has been proposed to deliver compressed air through a passageway of the tongue as a method for reducing the contact of the stream of filler with the tongue. However, such a method is not entirely effective in providing cigarette rods of consistent uniformity and high quality.

Various references propose introducing certain substances through the tongue during cigarette rod manufacture. For example, U.S. Pat. No. 4,186,754 to Labbe proposes feeding water or alcohol to the surface of the tongue which contacts the stream of a particular type of tobacco in order to dilute and reduce the viscosity of gum which reportedly builds up on the tongue. U.S. Pat. No. 4,409,995 to Nichols proposes applying flavorant in particulate or liquid form to a cigarette rod through the tongue region of a cigarette making machine. U.S. Pat. No. 4,619,276 to Albertson et al proposes applying flavorant in foam form to a cigarette rod through the tongue region of a cigarette making machine. However, the references address neither the high speed manufacture of cigarette rods nor the manufacture of cigarette rods having relatively high amounts of volume expanded smokable filler material.

It would be highly desirable to provide a process for manufacturing cigarette rods of highly consistent quality at high speeds.

SUMMARY OF THE INVENTION

The present invention relates to the preparation of cigarette rods of highly consistent quality at relatively high speeds (e.g., using cigarette making machines operating so as to manufacture a continuous cigarette rod at a speed in excess of about 500 m/min.). In addition, the present invention relates to the preparation of cigarette rods using a smokable filler having a high filling capacity (e.g., having a filling capacity of at least 500, as determined using a technique described hereinafter). Of particular interest is the efficient and effective preparation of cigarette rods having relatively high amounts of volume expanded smokable material filler (e.g., having at least 40 weight percent of the filler being volume expanded filler material) contained therein.

More particularly, the present inventIon relates to a process for producing cigarette rods. The process involves establishing and maintaining a supply of smokable filler material. The smokable filler material can have a high filling capacity, and generally a relatively high proportion of the smokable filler material is volume expanded smokable filler material. A continuous stream of the smokable filler is established, and the stream is draped into or otherwise deposited onto a web of wrapping material. The cross-sectional area of the stream is reduced using a constriction member having a filler-contacting surface. While the stream is being reduced in cross-sectional area, a liquid fluid is introduced to at least a portion of the filler-contacting surface of the constriction member. The wrapping material then is secured around the filler thereby forming a continuous rod. The continuous rod can be manufactured in such a manner at a relatively high speed. The continuous rod so provided then can be subdivided into a plurality of rods of the desired length.

The process of the present invention provides for the efficient and effective manufacture of cigarette rods using smokable filler material having a high filling capacity due to the hydrostatic lubrication provided to the filler-contacting surface of the constriction member (e.g., tongue). In particular, when a stream of smokable filler is compressed during the manufacture of a continuous cigarette rod, compressive as well as retardant forces are applied to the moving stream. The compressive and retardant forces tend to adversely affect the uniform movement of the smokable filler stream upon contact with the tongue. Such compressive and retardant forces tend to increase with an increase in the speed at which the cigarette rod is manufactured, and at very high rod-making speeds, there is reached a point at which uniform movement of the filler stream is prohibited. In particular, for a filler stream moving at a very high speed, the driving forces which provide for the movement of the filler through the tongue region are exceeded at some point by the frictional forces which occur in the tongue region. Surprisingly, the introduction of a liquid fluid (e.g., water) to the filler-contacting surface of the tongue according to the present invention provides a friction-reducing character to the filler-contacting surface of the tongue. As such, a continuous cigarette rod of unexpectedly high consistent quality can be manufactured at very high speeds (e.g., at a rate greater than about 500 meters per minute). In particular, cigarette rods of controlled density and firmness, and having very low amounts of hard spots, soft spots and loose ends, can be manufactured.

DETAILED DESCRIPTION OF THE PREFERRED EMBODIMENTS

A cigarette rod making machine useful in carrying out this invention is of the type commercially available from Molins PLC or Hauni-Werke Korber & Co. KG, and the use thereof is well known to the skilled artisan. For example, a preferred cigarette rod making machine of the type known as PROTOS (commercially available from Hauni-Werke Korber & Co. KG) can be employed and directly coupled with a filter tipping machine such as a MAX 80 (commercially available from Hauni-Werke & Korber & Co. KG). A description of a PROTOS cigarette making machine is provided in U.S. Pat. No. 4,474,190 to Brand at col. 5, line 48 through col. 8, line 3, which is incorporated herein by reference. Other cigarette rod making machines, such as the PROTOS 100 (manufactured by Hauni-Werke Korber & Co., KG) and the Molins MK 10N (manufactured by Molins PLC), can be employed.

Figure 1:
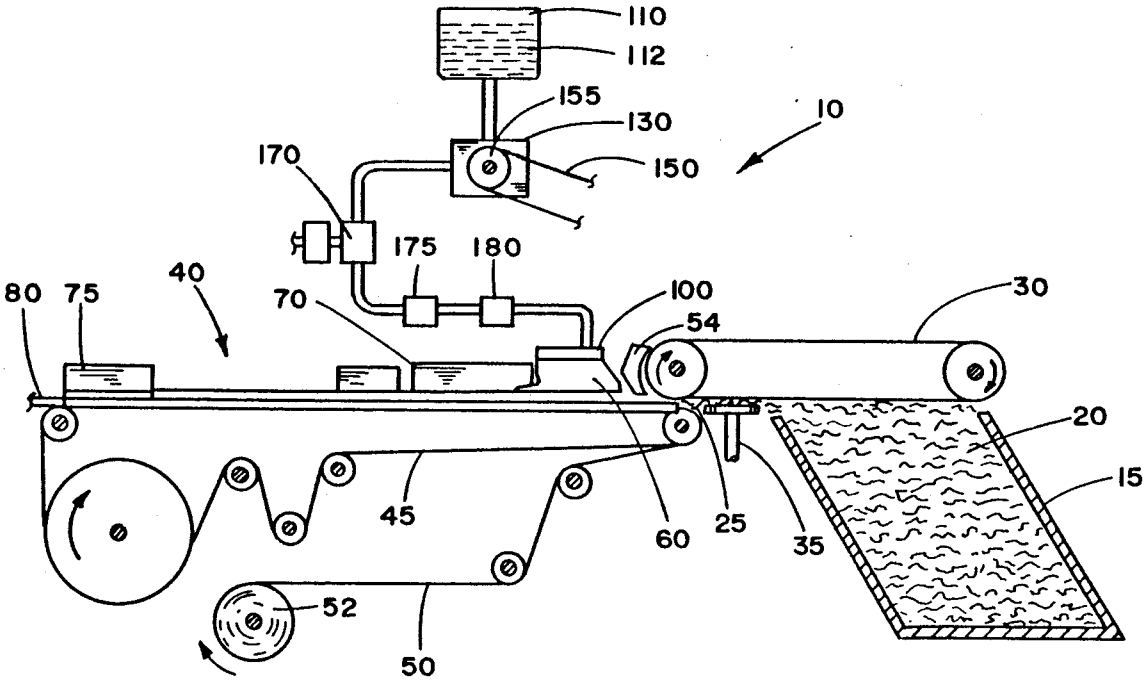
FIG. 1 is a schematic illustration of a portion of a cigarette making machine used according to the process of the invention.

Referring to FIG. 1, cigarette making machine 10 includes a tobacco source, such as chimney 15, through which tobacco filler 20 or other smoking material is established in a continuous stream 25 on endless, porous, formable conveyor belt 30. As such, a source of tobacco filler is established and maintained in order that a continuous stream of tobacco filler is supplied. The stream of tobacco filler is conveyed by belt 30 past trimming or equalizing device 35 in order to supply a uniform stream of filler.

The cigarette making machine 10 also includes a garniture section 40. The garniture section includes endless formable garniture conveyor belt 45. The garniture conveyor belt advances continuous web 50 of wrapping material, such as cigarette paper, from bobbin 52. One end of the conveyor belt 45 is positioned adjacent to and below the exit end of the porous belt 30 in order that the tobacco stream is deposited on the wrapper web 50. A short tongue 54 located above belt 45 in the garniture section 40 begins to constrict the stream as the belt begins to form the filler stream and wrapper web 50 into a continuous rod. A tongue 60 located above belt 45 in the garniture section 40 constricts the stream 25 as the belt forms the filler and wrapper web 50 into a continuous rod. The tongue 60 extends to a point where the wrapper material is secured around the filler stream. The tongue and the belt 45 carrying the wrapper web 50 defines a passage which progressively decreases in cross-section in the direction of movement of the filler stream such that the filler stream progressively assumes a substantially circular cross-section, so as to form the filler stream into substantially the desired cross-section of the ultimate finished cigarette rod. A formed tobacco rod exits the tongue 60, and an adhesive is applied using adhesive applicator 70 to an exposed length or lap region of the web The exposed length of wrapping material then is lapped onto itself, and the adhesive is set in region 75 in order to secure the wrapping material around the filler thereby forming a continuous cigarette rod 80. The rate at which the continuous rod is manufactured is essentially equal to the rate at which the stream 25 of tobacco filler is established and supplied. The continuous rod can be subdivided into a plurality of rods, each of the desired length, using known techniques. Although the circumference of cigarette rods can vary, typical rod circumferences range from about 19 mm to about 27 mm, and more typically from about 22 mm to about 25 mm.

Figure 3:
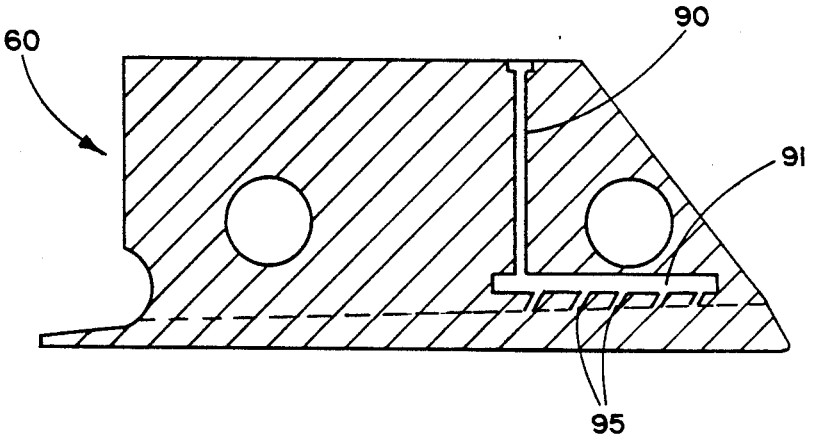
FIG. 3 is a sectional, longitudinal view of the tongue shown in FIG. 2.
Figure 2:
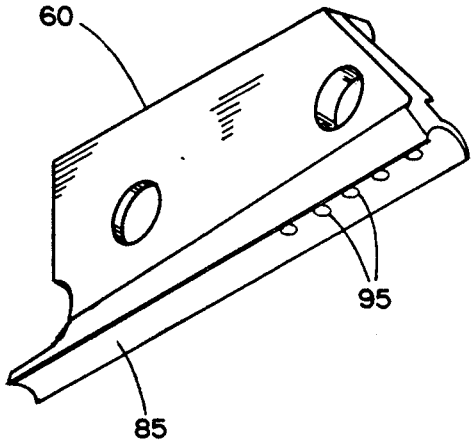
FIG. 2 is a perspective of a tongue used according to the process of this invention.

Referring to FIGS. 2 and 3, tongue 60 is manufactured from bronze, carbon steel, stainless steel, or the like. The tongue has a concave filler-contacting surface. By this is meant that surface 85 (shown in FIG. 2) has a shape which is sufficient to form the filler stream which comes into contact therewith into a rod-like shape having the desired cross-sectional shape. For typical cigarette rods having a generally circular cross section, the filler contacting surface of the tongue typically has a generally semi-cylindrical configuration. The filler-contacting surface of the tongue can be surface-treated, if desired. For example, the filler-contacting surface can be treated with a ceramic having a low coefficient of friction. Alternatively, the surface of the tongue can be manufactured from a porous material, such as a sintered metal. In such a manner, liquid which is fed into the tongue can exit the filler-contacting surface through the composite material. Furthermore, a tongue having suitable bores therethrough can have the filler-contacting surface thereof treated with a porous material.

As shown in FIG. 3, the tongue conveniently can be employed according to this invention by introducing a liquid fluid into the tongue through vertical bore or passageway 90, through associated horizontal passageway 91, and in turn through one or more associated liquid outlet openings 95. It is preferable that the liquid outlet openings be positioned towards the end of the tongue which first contacts the tobacco filler st ream (i.e., the upstream end of the tongue).

The liquid outlet openings in the filler-contacting surface of the tongue can vary in number, shape and positioning. For example, the liquid outlet opening can be a single opening toward upstream end of the tongue, or the outlet opening can be a plurality of outlet openings positioned longitudinally along the filler-contacting surface of the tongue (as shown in FIGS. 2 and 3). Although the total number of liquid outlet openings can vary, it is preferable to employ less than 10 outlet openings. The cross-sectional shape of the outlet openings can be circular, oval, or the like. For example, outlet openings having a circular cross-sectional shape often can have diameters which range from about 0.25 mm to about 1.5 mm. The outlet openings most desirably are positioned at an angle less than 90° relative to the surface of the filler stream so as to minimize the possibility of clogging the openings by smokable filler particles from the moving stream. It also is possible to employ grooves or channels which extend generally along the longitude of the filler-contacting surface of the tongue from each opening in order to promote a dispersion of the liquid across the entire filler-contacting surface of the tongue. Preferably, the liquid outlet openings are positioned within the upstream half, more preferably the upstream third, of the longitudinal length of the filler-contacting surface of the tongue.

The liquid fluid used in the process of the present invention is one which exhibits lubricative properties. Preferably, the liquid is an aqueous liquid, and most typically is essentially pure water. The liquid also can be an alcohol such as methanol, ethanol, isopropanol, or the like. Mixtures of miscible liquids or liquids having compatible solubilities can be employed. Additives such as surfactants and flavorants can be incorporated into the liquid, if desired.

The amount of liquid employed can vary. For example, when water is used, about 2 ml/min. to about 20 ml/min., preferably about 4 ml/min. to about 16 ml/min. thereof is passed through the tongue for a cigarette making machine operating so as to manufacture a continuous rod at a rate between about 270 m/min. and about 550 m/min. Typically, the amount of liquid passed through the tongue increases as the rate of cigarette rod manufacture increases. For example, when a continuous rod is manufactured at a rate greater than about 540 m/min., it is preferable to feed an aqueous liquid through the tongue at a rate greater than about 15 ml/min. The amount of liquid passing through the tongue also can vary depending upon the composition of the blend of filler which is employed to manufacture the cigarette rod. For very high speed cigarette rod manufacture rates, the optimum liquid delivery rate through the tongue can be determined by experimentation.

Figure 4:
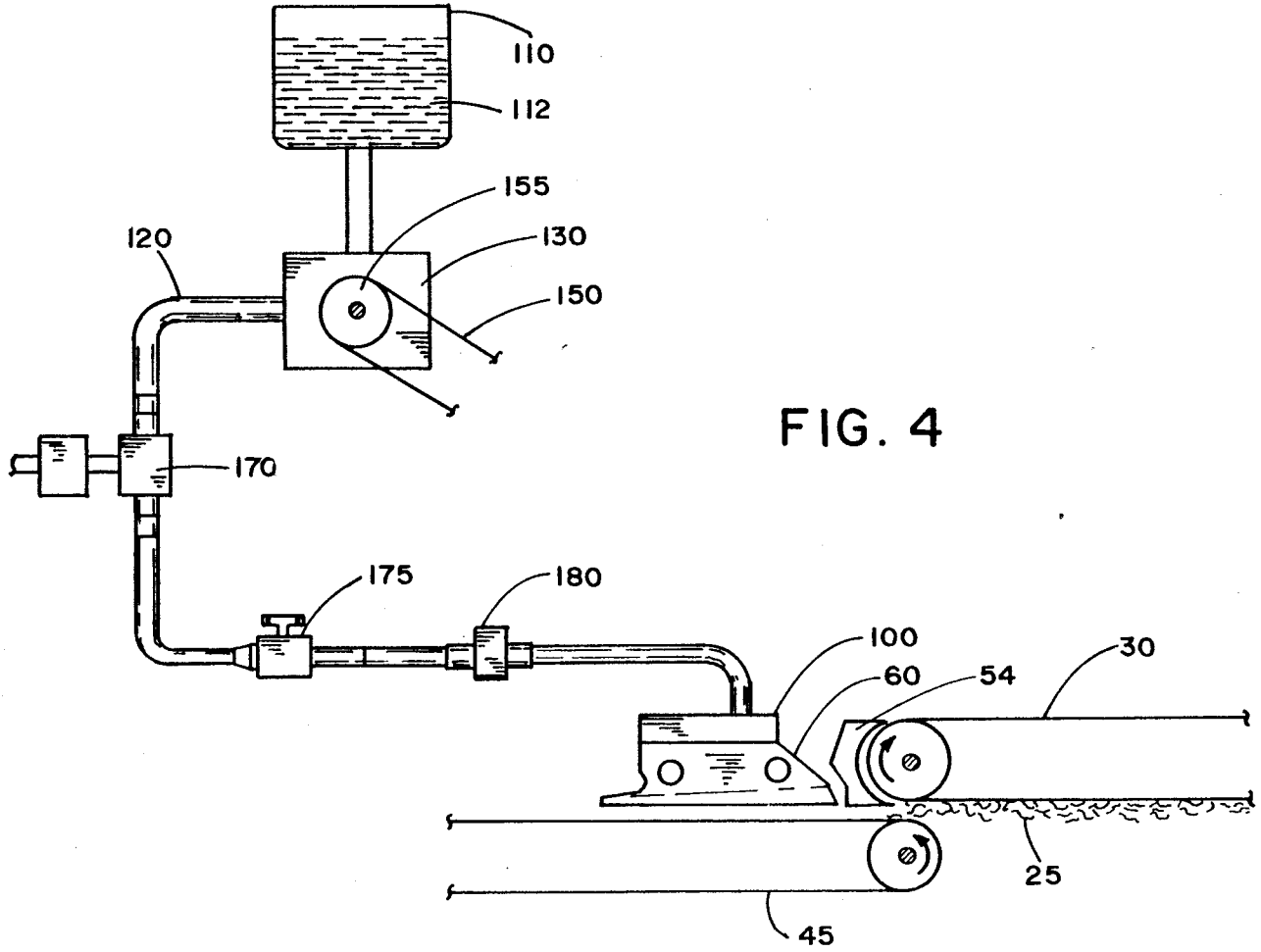
FIG. 4 is an enlarged schematic illustration of a portion of the cigarette making machine shown in FIG. 1.

Referring to FIGS. 1 and 4, tongue 60 is supported and maintained in place in the garniture region 40 of the cigarette making machine 10 using cantilever beam member 100. A reservoir tank 110 for the liquid fluid 112 is used to provide for a flow of the liquid through the tongue through a passageway (not shown) in the cantilever beam member 100 by way of a series of tubes 120 and pumping mechanism 130. The pumping mechanism provides ±or a positive ±low of liquid through the tongue in the desired amount during the cigarette rod formation process. A low volume positive displacement piston pump is a particularly preferred pumping mechanism. A pumping mechanism timed to the drive shaft (not shown) of the rod making machine using a timing belt mechanism 150 and pulley 155, can ensure that the desired amount of liquid flows through the tongue at a particular cigarette rod formation speed.

It is preferable that the pumping mechanism 130 deliver a consistent amount of liquid for passage through the tongue 60. For example, though a pumping mechanism which provides a pulsed delivery of fluid can be employed, a pulsating flow of liquid can tend to cause the formation of an aesthetically objectionable discoloration or staining.

If desired, a three-way valve 170, a quick disconnector member 175 and a filter element 180 can be employed. The three-way valve 170 can be of the type commercially available as No X53LB1100 from Skinner Valve Div. of Honeywell, Inc., New Britain, Conn.; and provides for a recyclization of liquid pumped from the reservoir 110 by the pumping mechanism 130 prior to the time that the continuous tobacco rod is manufactured at a speed great enough to require the introduction of liquid through the tongue. The use of the three-way valve 170 is particularly useful during start-up and shut-down periods of cigarette rod manufacture. The quick disconnect member 175 is a combination of part numbers MCD 10-02 and MCD 20-04 from Genoa Corp., St. Paul, Minn., and is employed for convenient servicing of the rod-making machine. The filter element 180 can be a 15 micron filter such as is available as SS-4FW-15 from Nupro Co., Willoughby, Oh. The filter element can act to prevent blockage of the passageways which extend through the tongue as well as dampen any surges or pulses in the liquid flow which passes to the tongue.

The wrapping material useful herein can vary, and most conveniently is a cigarette paper wrap of the type commonly used for cigarette rod manufacture. Examples of suitable paper wrapping materials are manufactured from flax fiber and calcium carbonate filler, and are commercially available as Reference Nos. 719 and 856 from Kimberly-Clark Corp. Also useful are those paper wrapping materials available as Ecusta Experimental Nos. TOD 01788, TOD 03363 and TOD 03732 from Ecusta Corp. Such paper wrapping materials generally are provided as a web in the form of a bobbin.

The smokable filler employed for the manufacture of the cigarette rod can vary. The smokable filler generally employed in a cut filler form, which is blended, cased, cut and flavored filler ready for cigarette manufacture. Smokable filler can be tobacco material, as well as tobacco substitute materials such as carbonized or pyrolyzed materials, organic and inorganic filler materials, and the like. As such, cut filler can be strands or shreds of tobacco laminae, processed stems or reconstituted tobacco, which can have widths ranging from about 1/25 inch to about 1/60 inch, preferably from about 1/30 inch to about 1/40 inch.

The process of this invention allows the skilled artisan to efficiently and effectively manufacture cigarette rods using smokable filler blends having high filling capacities. By "filling capacity" is meant the ability of filler at a particular moisture content to form a firm cigarette rod. See, *Tobacco Encyclopedia*, edit. by E. Voges, TJI (1984), pp. 457–459. As such, filler materials having high filling capacities require a relatively low weight of filler to produce a cigarette rod. For purposes of this invention, the filling capacity of a particular smokable filler material is determined by charging the filler of a known weight into a tube having a height of about 200 mm and an inner diameter of about 96 mm. Typically, enough filler is employed to fill the tube about ¾ full. A piston having a height of about 170 mm and an outer diameter of about 93.5 mm includes a support housing such that the piston and housing weighs about 26 pounds. The piston is lowered onto the filler and is allowed to rest on the filler. After the piston and housing rests on the filler for 5 seconds, the volume occupied by the filler within the cylinder is recorded. Typical high filling capacities for purposes of this invention are greater than about 500, frequently greater than 550, often greater than 600, and sometimes greater than 650. Such filling capacity values are reported in units of milliliters per 2.3 psi per 100 g of filler at 12 weight percent moisture at 76° F. (24.4° C.) as determined using the previously described procedure. Generally, blends having such high filling capacities are employed, for purposes of this invention, at a moisture content of about 12 weight percent to about 14 weight percent, more often about 13 weight percent (i.e., at the moisture content at which cut filler conventionally is employed in the manufacture of cigarette rods).

Typical high filling capacity blends include a relatively high proportion of volume expanded filler as the filler material used to manufacture the cigarette rods. For example, a t least about 40 weight percent, frequently at least about 50 weight percent, often at least about 60 weight percent, and even at least about 70 weight percent of the filler material is volume expanded filler material. As used herein, "volume expanded filler material" is used to refer to a smokable material which has a specific gravity less than hexane. Volume expanded filler materials can be volume expanded tobacco cut filler, volume expanded cut tobacco stems, volume expanded tobacco substitutes such as puffed grains, and the like. Methods for providing volume expanded smokable filler materials are well known to the skilled artisan. In particular, smokable filler materials generally are impregnated with an expansion agent such as carbon dioxide, halocarbons, propane, ammonium carbonate, water, or the like; and the expansion agent is rapidly vented to expand the cell structure of the smokable material. Typically, volume expanded smokable materials exhibit volume increase of about 50 percent to about 250 percent, more frequently about 60 percent to about 120 percent, relative to the volume of the smokable material prior to volume expansion treatment.

The volume expanded filler material and the other smokable filler materials of the smokable blend are blended using known techniques. However, if desired, essentially all of the smokable material used to manufacture cigarette rods according to this invention can be volume expanded filler material. In addition, in most instances, essentially all of the smokable filler material used to manufacture cigarette rods according to this invention is tobacco material.

The following example is provided in order to further illustrate the invention but should not be construed as limiting the scope thereof. Unless otherwise noted, all parts and percentages are by weight.

EXAMPLE 1

A PROTOS cigarette making machine coupled with a MAX 80 tipping machine is equipped with a tongue of the type shown generally in FIGS. 2 and 3. The tongue is machined from Hauni-Werke Korber & Co. KG, Part No. HPM-38-DS-63F-1. The tongue includes a first vertical passageway having a diameter of 1.57 mm, a second horizontal passageway having a diameter of 2.36 mm, and 5 openings of 0.37 mm diameter. The openings are longitudinally aligned along the length of the filler-contacting surface of the tongue, and each of the openings are positioned 5 mm apart. The extreme upstream opening is positioned 7 mm from the extreme upstream end of the tongue. The openings each are positioned at an angle of 60° relative to a horizontal plane.

The tongue is held in place using a suitably modified cantilever beam member (Part No. HPM-39-DS-8). A 1.57 mm diameter passageway extends through the cantilever beam member so as to communicate with the vertical passageway of the tongue Tap water at about 22° C. is fed from a reservoir through Poly-Flo tubing of 3.18 mm inner diameter through a RH1CKC positive displacement pump manufactured by Fluid Metering, Inc., Oyster Bay, N.Y., and through Poly-Flo tubing and into the tongue. The flow rate of water through the tongue is controlled as the pump is timed with the drive shaft of the cigarette making machine.

A smokable blend comprises about 83 percent volume expanded flue-cured tobacco cut filler and about 17 percent Oriental tobacco cut filler. The moisture content of the blend is about 13 percent. The volume expanded tobacco is flue-cured cut filler which has been expanded by about 80 percent of its original volume using techniques substantially as described by Fredrickson in U.S. Pat. No. Re 30,693. The filling capacity of the blend is about 600, as determined using the procedure described hereinbefore. Also, a bobbin of Ecusta Corp. experimental paper No. TOD 03732 is provided. Cigarettes are manufactured using these materials. In particular, a continuous cigarette rod having a circumference of 24.85 mm is manufactured at a rate of greater than 545 meters per minute. Cigarettes of 99 mm length (cigarette rod length of 68 mm and filter element length of 31 mm) are manufactured from the continuous rod. As such, in excess of 8,000 cigarettes are manufactured per minute. When water is not fed through the tongue, and cigarettes are manufactured over a 20 minute period, an average of 5.95 percent of the cigarettes are rejected as having loose ends. During such a period, the measured temperature at the filler-contacting surface of the tongue is greater than 80° C. When water is fed through the tongue at 16 ml/min., an average of 0.31 percent of the cigarettes are rejected as having loose ends. Thus, the use of the process of the present invention results in a decrease in the number of rejected cigarettes by almost 90 percent. When water is fed through the tongue, the measured temperature at the filler-contacting surface of the tongue is less than 50° C. In addition, the life of the tongue is significantly increased when water is fed therethrough during the cigarette rod manufacturing process.

What is claimed is:

1. A process for providing cigarette rods, the process comprising:

(a) supplying a continuous stream of smokable filler, at least 40 percent by weight of which is volume expanded filler;

(b) depositing the stream on a web of wrapping material;

(c) reducing the cross-sectional area of the stream of filler using a contriction member having a filler-contacting surface; and (d) introducing a liquid fluid to at least a portion of the filler-contacting surface of the constriction member in order to provide a friction-reducing character to the filler-contacting surface.

2. The process of claim 1 comprising supplying said continuous stream of smokable filler, at least 50 percent by weight of which is volume expanded filler.

3. The process of claim 1 further comprising supplying said continuous stream of smokable filler, at least 60 percent by weight of which is volume expanded filler.

4. The process of claim 1 further comprising supplying said continuous stream of smokable filler, essentially all of which is volume expanded filler.

5. The process of claim 1 further including supplying the continuous stream of smokable filler at a rate greater than about 500 meters per minute and securing the wrapping material around the filler thereby forming a continuous rod at a rate greater than about 500 meters per minute.

6. The process of claim 1 further including supplying the continuous stream of smokable filler at a rate greater than about 540 meters per minute and securing the wrapping material around the filler thereby forming a continuous rod at a rate greater than about 540 meters per minute.

7. The process of claim 2 further including supplying the continuous stream of smokable filler at a rate greater than about 500 meters per minute and securing the wrapping material around the filler thereby forming a continuous rod at a rate greater than about 500 meters per minute.

8. The process of claim 2 further including supplying the continuous stream of smokable filler at a rate greater than about 540 meters per minute and securing the wrapping material around the filler thereby forming a continuous rod at a rate greater than about 540 meters per minute.

9. The process of claim 3 further including supplying the continuous stream of smokable filler at a rate greater than about 500 meters per minute and securing the wrapping material around the filler thereby forming a continuous rod at a rate greater than about 500 meters per minute.

10. The process of claim 3 further including supplying the continuous stream of smokable filler at a rate greater than about 540 meters per minute and securing the wrapping material around the filler thereby forming a continuous rod at a rate greater than about 540 meters per minute.

11. The process of claim 1, 2, 3,4,5,6,7, 8, 9, or 10 whereby the liquid fluid is an aqueous liquid.

12. The process of claim 11 whereby essentially all of the smokable filler so supplied is tobacco material.

* * * * *